US005447597A

United States Patent [19]

Zimmermann et al.

[11] Patent Number: 5,447,597

[45] Date of Patent: Sep. 5, 1995

[54] APPARATUS FOR LOOSENING WALLPAPER

[75] Inventors: Guido Zimmermann; Klaus Buttenbender, both of Friedrichshafen, Germany

[73] Assignee: J. Wagner GmbH, Friedrichshafen, Germany

[21] Appl. No.: 400,189

[22] Filed: Mar. 6, 1995

Related U.S. Application Data

[63] Continuation of Ser. No. 202,343, Feb. 28, 1994, abandoned.

[30] Foreign Application Priority Data

Mar. 23, 1993 [DE] Germany ..... 43 09 241.1

[51] Int. Cl.[6] ..... F22B 1/28

[52] U.S. Cl. ..... 156/584; 126/271.1; 219/437; 392/325; 392/403; 392/404; 392/447; 156/344

[58] Field of Search ..... 156/344, 584; 126/271.1; 392/324, 325, 403, 404, 405, 406, 447; 219/437

[56] References Cited

U.S. PATENT DOCUMENTS

| | | | |
|---|---|---|---|
| 1,428,442 | 9/1922 | Lancaster | 126/271.1 |
| 2,478,370 | 8/1949 | Clark | 126/271.1 |
| 2,483,993 | 10/1949 | Becker | 392/403 X |
| 2,505,656 | 4/1950 | Wagner . | |
| 2,561,443 | 7/1951 | March | 392/404 |
| 2,726,314 | 12/1955 | Prain | 126/271.1 X |
| 2,849,736 | 9/1958 | Kohle | 392/404 X |
| 3,559,886 | 2/1971 | Howard | 126/271.1 X |
| 4,366,367 | 12/1982 | Mazzuco | 392/404 X |
| 4,414,037 | 11/1983 | Friedheim . | |
| 4,990,745 | 2/1991 | Bayles et al. . | |
| 5,305,415 | 4/1994 | Stevens | 392/325 X |

FOREIGN PATENT DOCUMENTS

| | | | |
|---|---|---|---|
| 885053 | 11/1971 | Canada | 216/219 |
| 0332445 | 9/1989 | European Pat. Off. | 219/437 |
| WO90/13771 | 11/1990 | United Kingdom . | |

*Primary Examiner*—Mark A. Osele
*Attorney, Agent, or Firm*—Hill, Steadman & Simpson

[57] ABSTRACT

An apparatus for loosening wallpaper by means of steam, consisting of a steam generator and a steam plate connected to the steam generator by a steam hose, in which the steam generator incorporates a boiler which is closeable by means of a cover provided with a carrying handle and containing an electrical heating element, the carrying handle provided on the cover being thermally separated from the cover. This embodiment ensures that if the apparatus is used correctly, an operator will not come into immediate contact with heated components or hot steam and burns and scalds will be avoided.

29 Claims, 7 Drawing Sheets

APPARATUS FOR LOOSENING WALLPAPER

This is a continuation of application Ser. No. 08/202,343, filed Feb. 28, 1994 now abandoned.

BACKGROUND OF THE INVENTION

The invention relates to an apparatus for loosening wallpaper or similar coverings from a carrying agent by means of steam produced from water, in which the apparatus comprises a steam generator and a steam plate for outputting the steam which is connected to the steam generator by means of a flexible steam hose, whereby the steam generator incorporates a fillable boiler which is sealable by means of a cover provided with a carrying handle, and whereby the steam generator contains an electrical heating element in order to heat up the water inside the boiler.

A device for loosening wallpaper is known from WO 90/13771. In this disclosure, the grip aperture in the carrying handle provided in the cover the steam generator for transportation of the latter is only separated from the steam chamber of the boiler by a partition wall, so that the carrying handle is always subject to heating as the device heats up, meaning that occasional burns due to touching the partition wall are unavoidable. In addition, there is the considerable danger that the connection between the boiler and cover could develop a leak, in particular due to the aging of a seal fitted between the boiler and the cover, thus causing hot steam to escape from the boiler.

It is also disadvantageous that the safety valve is inserted in the cover immediately next to the carrying handle and so if the appropriate degree of overpressure arises inside the steam generator, hot steam can escape in all directions from the safety valve, and therefore also in the direction of the carrying handle. Scalds to any person near the steam generator as a result of the hot steam are possible. Furthermore, because the safety valve is inserted into the top of the cover without any protection, the safety valve can possibly stick due to the influence of removed wallpaper pieces, thus resulting in impairment of its function. When using this known device, there is the possibility of accidents due to the high operating temperature of the medium and due to the steam generator which provides the steam, as well as the fact that the walls of the boiler and the cover are smooth and so do not provide protection against contact. What is more, operating faults due to the unfavorable location of the safety valve are possible.

SUMMARY OF THE INVENTION

Accordingly, an object of this invention is to improve the apparatus for loosening wallpaper of the type described above, in order that if it is used correctly, the possibility that an operator of the device could come into contact with heated elements or hot steam can, to all intents and purposes, be prevented. This is intended to provide a reliable protection against burns and scalds, as well as enabling simplicity and reliability of use and safe operation. The time, extent and cost of construction required to achieve this should be kept to a low level whilst nevertheless guaranteeing a continuous, effective degree of protection against injuries due to hot steam or contact with heated components.

In the present invention, this is achieved in an apparatus for loosening wallpaper of the type mentioned above by providing thermal separation between the carrying handle attached to the cover of the steam generator and the cover.

It is hereby advantageous to arrange the carrying handle so that it is thermally separated from the cover by means of one or more cavities provided between the carrying handle and the cover the steam generator which, in a preferred embodiment, are open at one or both sides, and to attach the bow-shaped carrying handle to the cover by means of at least two bars running at an approximately perpendicular angle to the longitudinal direction of the carrying handle.

In addition, the carrying handle can have approximately the shape of an obtuse-angled triangle, the first side of which is arranged so that it runs from the outer edge of the cover approximately parallel to, and with a clearance from, the inside of the cover, with the second side of the triangle attached to the end of the first side and projecting from this end at an obtuse angle formed with the first side, and with the third side of the triangle, which is in the form of a grip, connected to the free ends of the first and second sides of the carrying handle.

Furthermore, it is appropriate to provide a steam collector housing connected to the interior of the boiler and shaped onto the carrying handle at the connection with its second side, whereby the steam collector housing can have a triangular cross section in the direction of the carrying handle and whereby the wall of the steam collector housing facing the carrying handle should run in parallel to, and with a clearance from, the second side of the carrying handle, in such a way that one or more cavities are formed between the carrying handle and housing, which in a preferred embodiment are open at one or both sides, in order to provide thermal separation between the carrying handle and the housing.

The wall of the housing facing away from the carrying handle can additionally be provided with a filler neck, which in a preferred embodiment is shaped so as to provide a connection for the steam hose.

In a further embodiment, it is also advantageous to provide the carrying handle with a pressure relief valve which should preferably be replaceable and be inserted in the end area of the carrying handle located diametrically opposite the steam collector housing in order to connect the interior of the boiler with the atmosphere automatically, and to provide an outlet opening running radially outwards at an approximately perpendicular angle to the longitudinal axis of the boiler between the cover the boiler and the first side of the carrying handle, whereby the outlet opening is machined into an extension piece attached to the cover and is screened by the carrying handle, and should face towards the pressure relief valve.

Furthermore, it is advisable to connect the cover firmly to the boiler wall, for example by means of heat sealing the cover onto the boiler wall, and to provide a ring or projection formed onto the outside circumference of, and installed at a clearance to, both the boiler and/or the cover near the point where they are joined. In addition, the external casing of the boiler should be fitted in whole or in part with heat insulating ribs formed onto the casing and arranged at lateral intervals to each other.

The heating element of the boiler should be fitted in a conical or U-shaped depression formed in the base of the boiler.

The steam plate which can be connected to the steam generator should consist of an operating plate and a handle which is also thermally separated from the operating plate.

This can be achieved by arranging the handle so that it is thermally separated from the operating plate by means of one or more cavities provided between the handle and the operating plate which, in a preferred embodiment, are open at one or both sides and formed by bars.

In addition, the bow-shaped handle of the steam plate should have approximately the shape of an obtuse-angled triangle, the first side of which is arranged so that it runs approximately in parallel to, and with a clearance from, the housing of the operating plate, with the second side of the triangle attached to the front end of the first side, with the third side of the triangle being in the form of a grip attached to the rear end of the first side, and with the second and third sides connected together at an obtuse angle, whereby the first side of the bow-shaped handle extends along the axial length of the operating plate and the walls at the front and rear sections of the housing should be formed so they extend in the same direction as the second and third sides of the bow-shaped handle.

The grips of the carrying handle formed on the cover and/or of the bow-shaped handle formed on the operating plate should also be provided with cooling vanes along the whole or partial length of their inwardly facing sides, preferably in the form of machined notches, and the grips of the carrying handle formed on the cover and/or of the bow-shaped handle formed on the operating plate should be convexly curved along their whole or partial longitudinal lengths, or should demonstrate a convexly curved cross section along the whole or partial length of their inwardly facing sides.

The steam hose connecting the steam generator to the steam plate should be removable at either end and be connected to the steam generator and/or operating plate by means of union nuts, which in a preferred embodiment are provided with circumferential or axial heat insulating ribs in their outer surfaces.

If an apparatus for loosening wallpaper is constructed in accordance with the present invention, this ensures that if the apparatus is used correctly, the components of the apparatus which are intended to be touched cannot be heated up in an impermissible manner, and that an operator cannot come into immediate contact with heated components. Correspondingly, the risk of injury caused by burns and/or scalds will be small. Most importantly, this guarantees that hot steam escaping from the pressure relief valve is prevented from getting close to the carrying handle, because the pressure relief valve is screened by the cover and therefore hot steam escapes sideways between the cover and the boiler instead. Also, because the steam hose connection is in the form of a filler neck, the steam generator is easy to handle when filling the boiler. This therefore provides a device which combines simplicity of construction, operational safety and ease of operation, and which can be used without danger, in spite of the hot medium being processed.

DETAILED DESCRIPTION OF THE PREFERRED EMBODIMENTS

Figure 1:
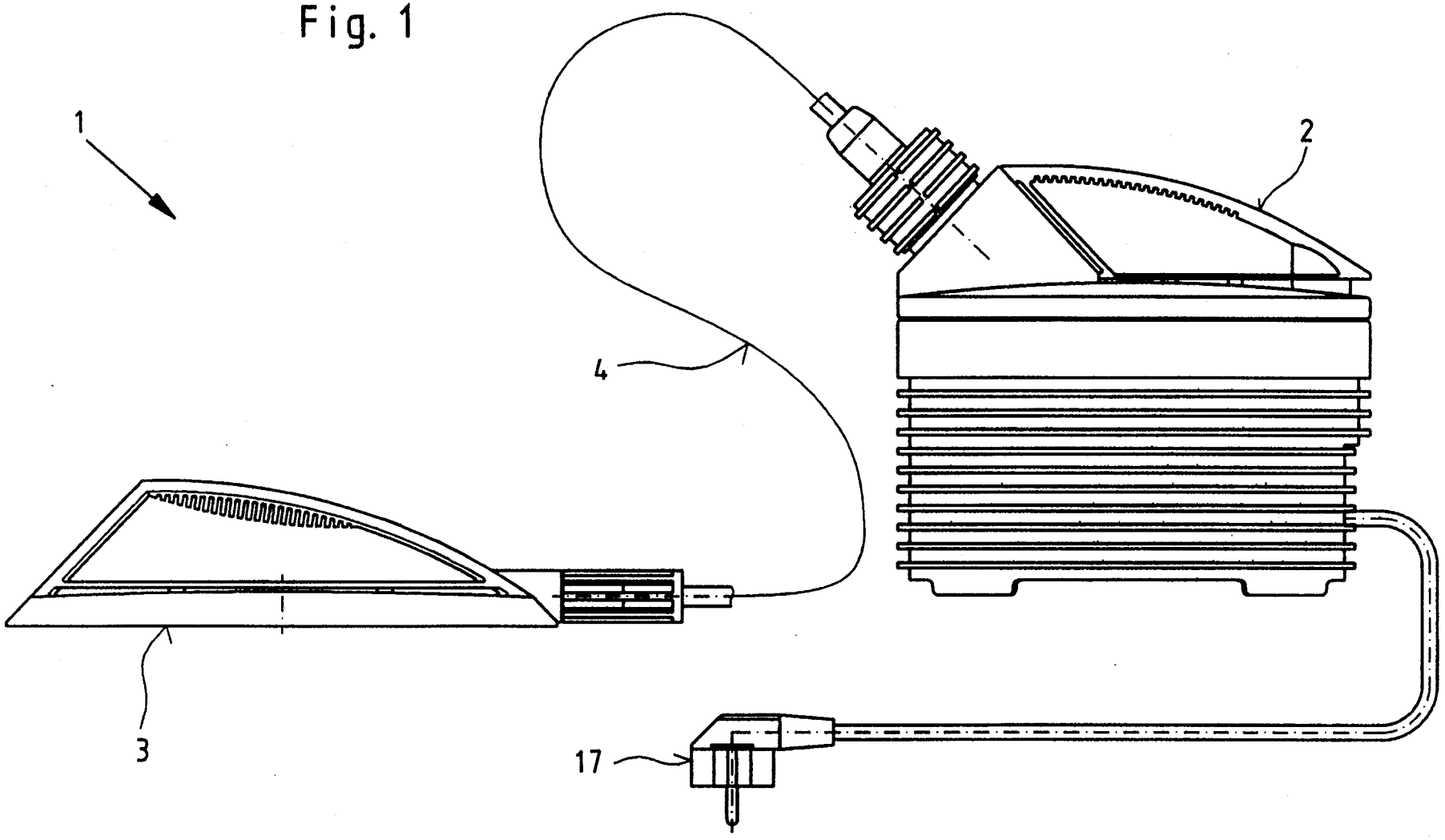
FIG. 1 is a side elevational view of an apparatus having a steam generator and steam plate connected to the steam generator.

The apparatus shown in FIG. 1 and marked with the number 1 is intended for loosening wallpaper or similar coverings from a carrying agent by means of hot steam. The apparatus provides a steam generator 2 and a steam plate 3 for outputting the steam which is connected to the steam generator 2 by means of a flexible steam hose 4. The hot steam created in the steam generator 2 which emerges from the steam plate 3 softens wallpaper and loosens it from the wall, so that it can be removed easily by such a means as a spatula or scraper.

Figure 2:
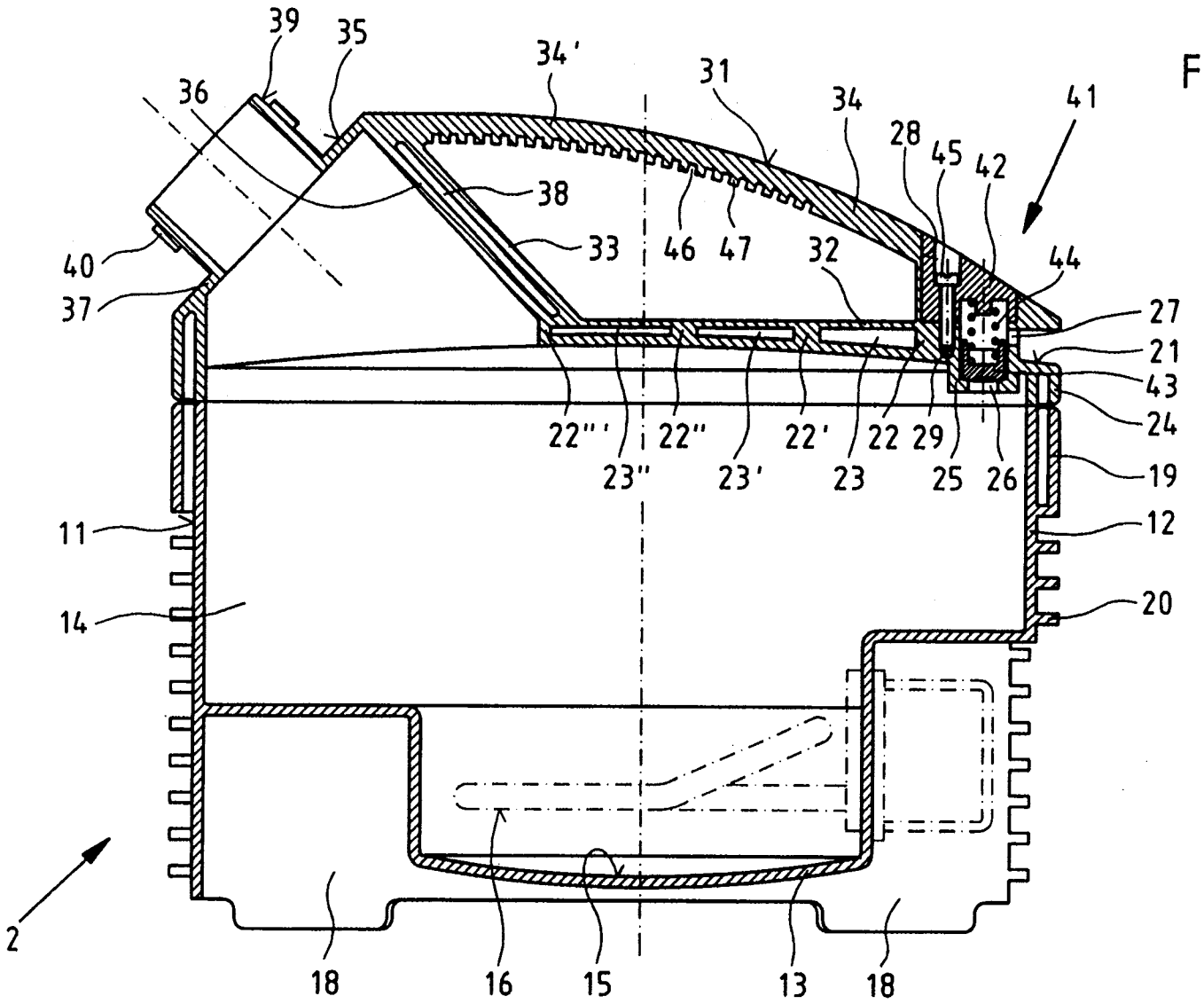
FIG. 2 is an axial cross sectional view of the steam generator of the apparatus of FIG. 1.
Figure 3:
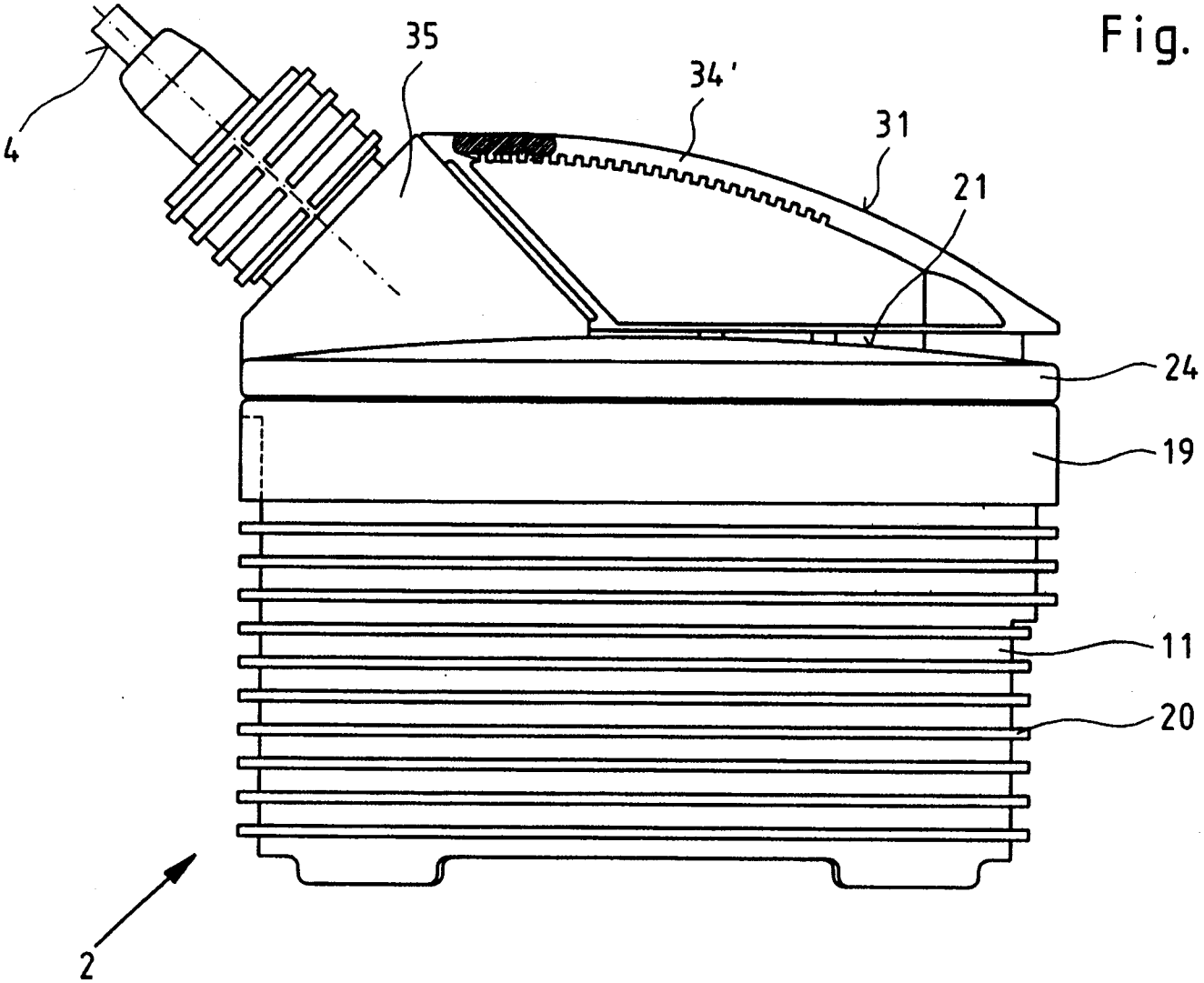
FIG. 3 is a side elevational view of the steam generator of FIG. 2.

As can be seen in particular in FIGS. 2 and 3, the steam generator 2 consists of a boiler 11 and a cover 21 which is firmly connected to the boiler 11, whereby an integrated carrying handle 31 is provided on the cover 21. In addition, a pressure relief valve 41 is inserted in the cover 21 and an outlet opening 27 which is directed radially outwards (rearwards as shown in FIG. 2) and which is screened by the cover 21 is connected to the pressure relief valve 41. In this embodiment, the steam plate 3 is formed by an operating plate 51 and a bow-shaped handle 61 formed onto the operating plate 51.

The boiler 11 of the steam generator 2 incorporates a cylindrical wall 12 and a base 13 inserted in the wall 12, whereby the base 13 is provided with a depression 15 for accommodating an electrical heating element 16. The heating element 16 can be connected to a power source by means of a plug 17. In addition, the boiler 11 is equipped with base supports 18 and a ring 19 is formed onto the outer surface of the wall 12 at a clearance from the wall 12. Furthermore, several heat insulating ribs 20 are arranged one above the other at intervals on the wall 12, in order to prevent direct contact with the wall 12.

The carrying handle 31 formed onto the cover 21 is thermally separated from the cover 21. In order to achieve this, several cavities 23, 23′ and 23″ which are open at both sides are provided between the cover 21 and the carrying handle 31, whereby the cavities 23, 23′ and 23″ are formed by bars 22, 22′, 22″ and 22‴ which run at a perpendicular angle to the longitudinal direction of the carrying handle 31. In addition, a ring-shaped circumferential projection 24 is provided on the cover 21 in such a way that the projection 24 lines up with the ring 19 of the boiler 11. The cover 21 can therefore be heat sealed onto the wall 12 of the boiler 11, whilst the heat sealed connection is concealed by the ring 19 and the projection 24.

The carrying handle 31 has the shape of an obtuse-angled triangle, being made up of three sides 32, 33 and 34. In this embodiment, the first side 32 runs radially inwards from the outer edge of the circular cover 21 with a clearance from the cover 21, the second side 33 is formed onto the end of the first side 32 and forms an obtuse angle with the first side 32. The third side 34 is in the form of a grip 34' and connects the first side 32 to the second side 33.

The grip 34' is convexly curved and provided with cooling vanes 47 on its inside surface which are formed by means of notches 46. In addition, a steam collector housing 35 is formed at the connection of the second side, whereby the steam collector housing 35 is permanently connected to the interior 14 of the boiler 11.

In this embodiment, the steam collector housing 35 demonstrates a triangular cross section in the direction of the carrying handle 31, and the wall 36 of the steam collector housing 35 which faces the carrying handle 31 runs with a clearance to the second side 33, with the consequence that the second side 33 is also thermally separated from the steam collector housing 35 by means of a cavity 38 which is open at both sides. The wall 37 on a front side of the steam collector housing 35 facing away from the carrying handle 31 is provided with a filler neck 39 which is formed as the connection for the steam hose 4 and demonstrates an external screw thread 40 for this purpose.

The pressure relief valve 41 provides an automatic connection between the interior 14 of the boiler 11 and the atmosphere whenever a certain level of overpressure exists within the boiler 11. The relief valve 41 provides a valve body 43 within an insert 42 placed inside a recess 28 in the cover 21, and a valve spring 44 which acts on the valve body 43 and is supported against the insert 42. In this embodiment, the valve body 43 is movably guided inside an extension piece 25 formed in the cover 21, whereby a bore 26 is also machined into the extension piece 25, by means of which the pressure in the interior 14 of the boiler 11 is continuously able to act on the valve body 43. The insert 42 is fixed inside the recess 28 by means of a screw 45 which is screwed into a bore 29 machined into the cover 21.

Figure 4:
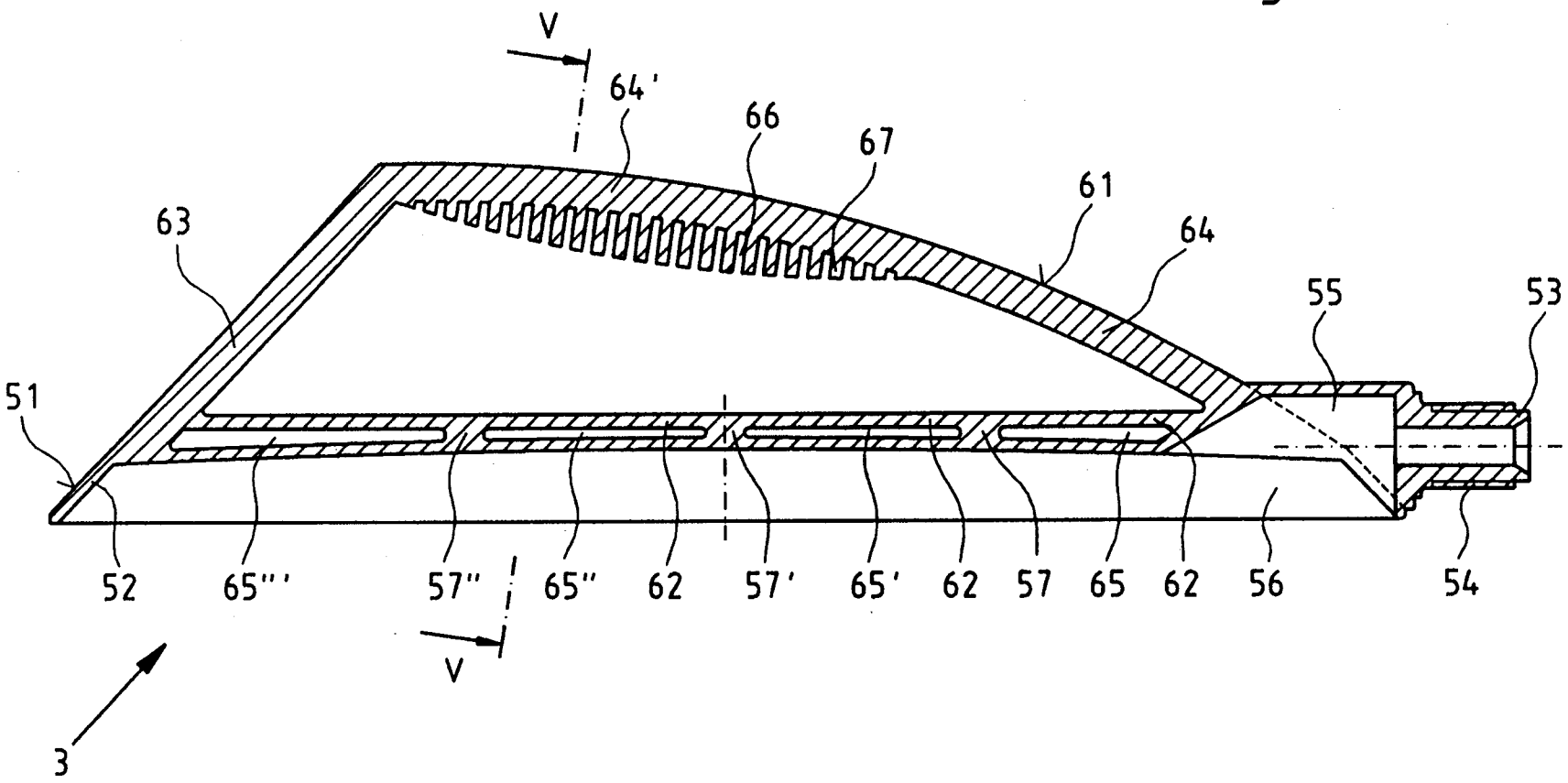
FIG. 4 is an axial cross sectional view of the steam plate of the apparatus of FIG. 1.
Figure 5:
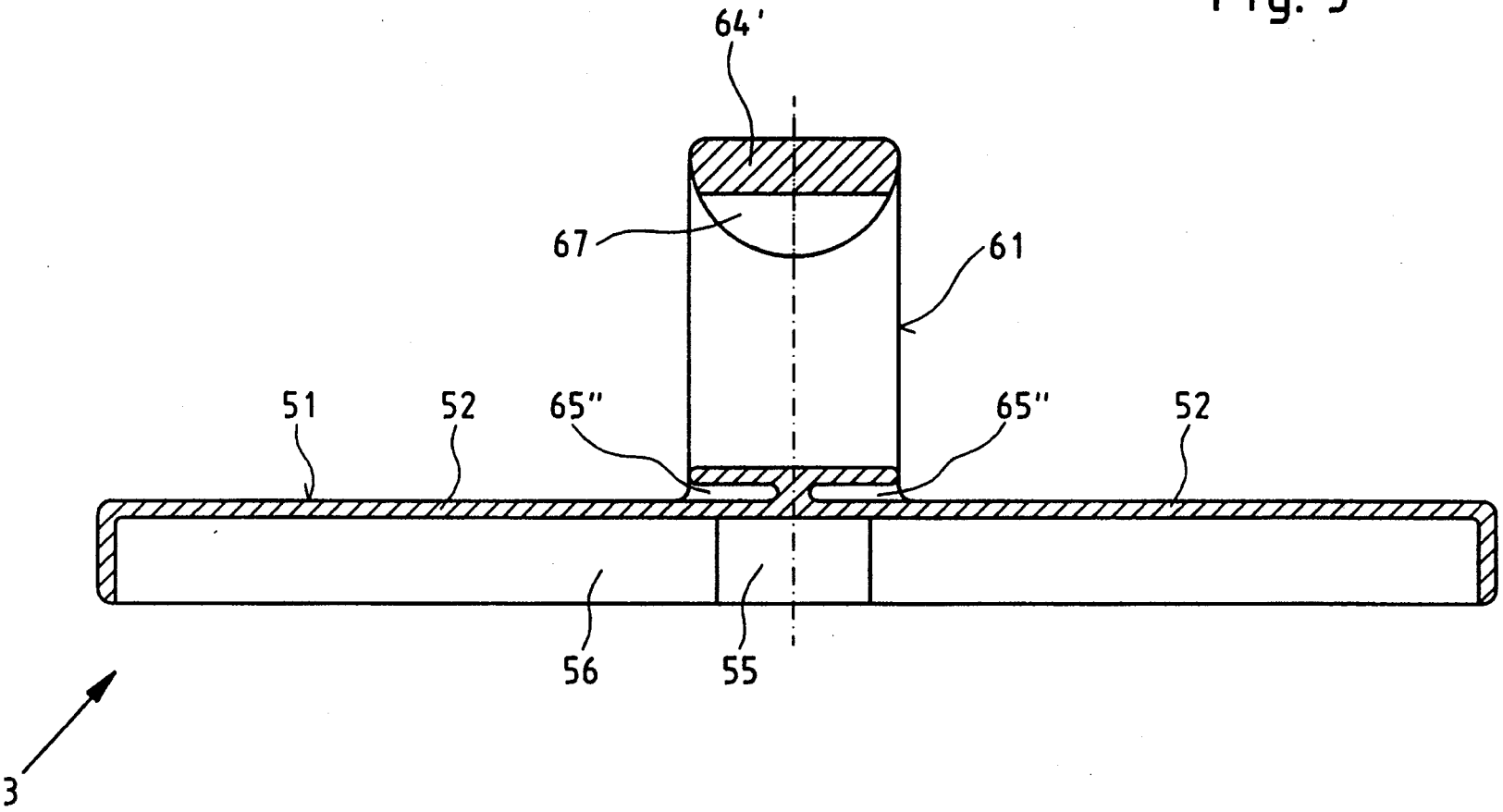
FIG. 5 is a cross sectional view taken generally along line V—V of FIG. 4.
Figure 6:
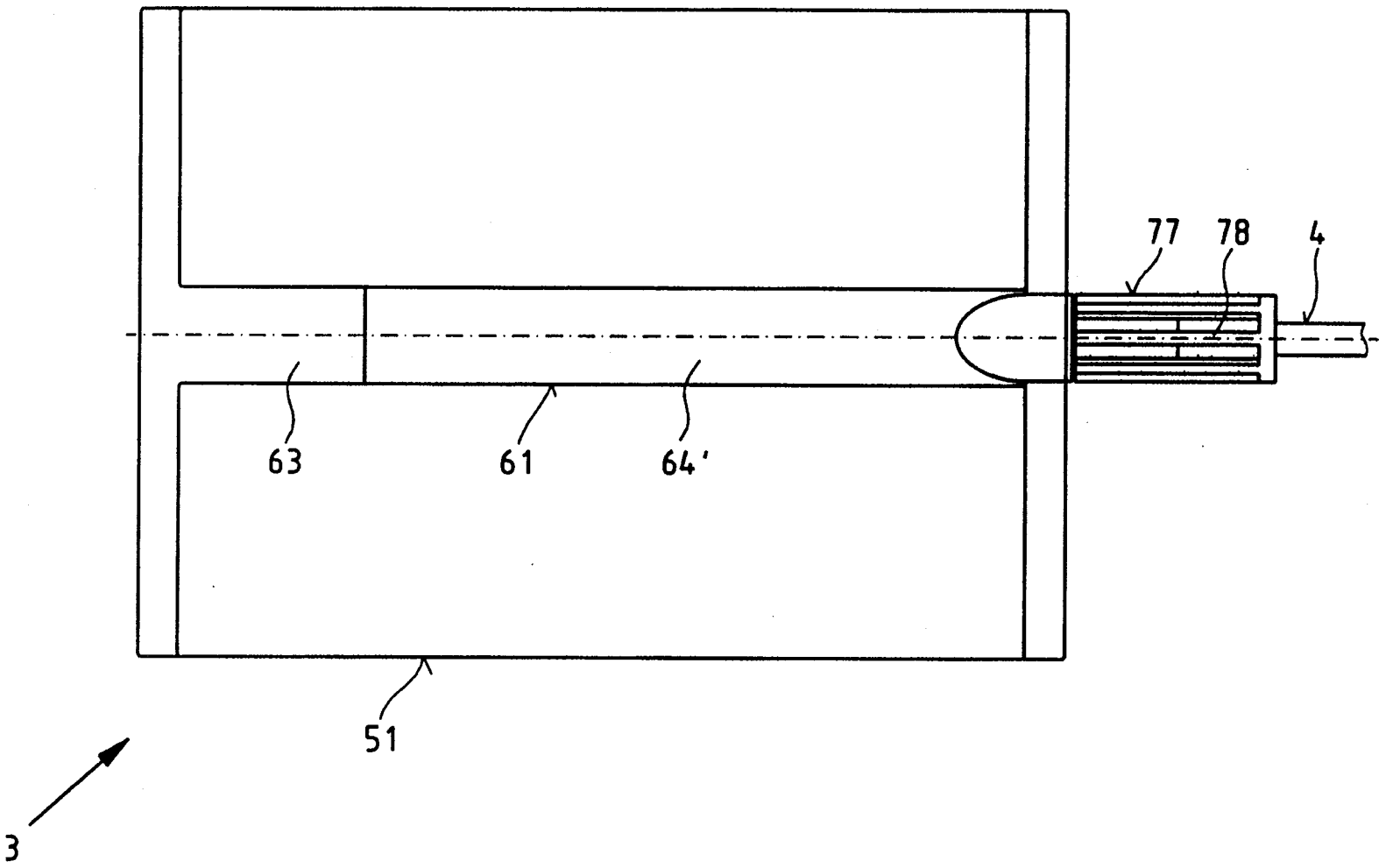
FIG. 6 is a plan view of the steam plate of FIG. 4.

The steam plate 3 shown in FIGS. 4, 5 and 6 consists of the operating plate 51 and the bow-shaped handle 61 which is thermally separated from the operating plate 51 by means of several cavities 65, 65', 65'' and 65''' which are provided between the bow-shaped handle 61 and the operating plate 51 and are open at both sides. The cavities 65, 65', 65'' and 65''' are themselves formed by bars 57, 57' and 57''.

The bow-shaped handle 61 also has the shape of an obtuse-angled triangle, the first side 62 of which runs approximately in parallel to the operating plate 51 and is attached with a clearance from the operating plate 51 in order to form the cavities 65, 65', 65'' and 65'''. The second side 63 is attached to the front end of the first side 62 and the third side 64 is attached to the rear end of the first side 62. The second side 63 is connected to the third side 64 to form an obtuse angle, whereby the third side 64 is in the form of a grip 64' and is provided with cooling vanes 67 formed by machined notches 66. The housing 52 of the operating plate 51 provides a connection 53 having an external thread 54 in order to connect the steam hose 4 and is also equipped with a distribution chamber 55 from which the supply of hot steam flows into a steam chamber 56. The steam inside the steam chamber 56 acts directly on the wallpaper which is covered by the operating plate 51.

Figure 7:
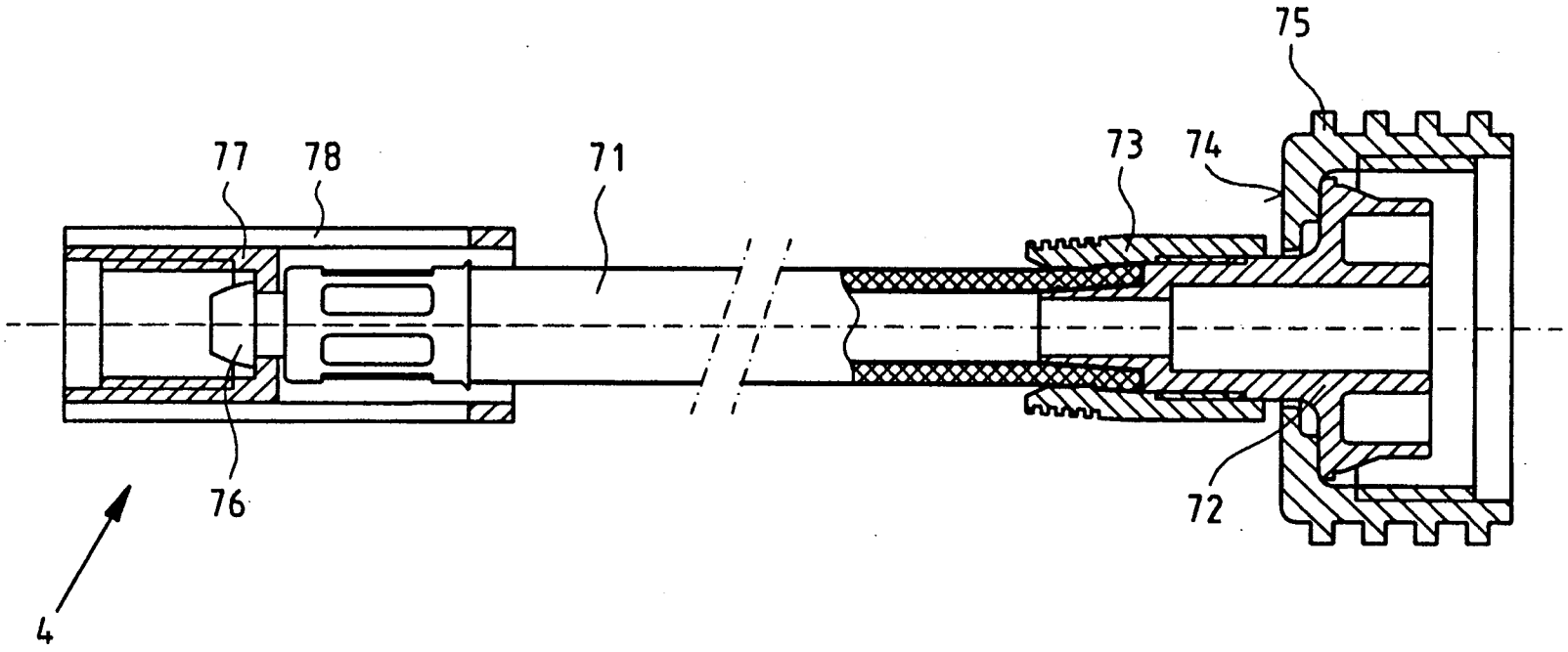
FIG. 7 is an axial cross sectional view of the steam hose for connecting the steam generator to the steam plate.

In accordance with FIG. 7, the steam hose 4 consists of a flexible hose pipe 71 and two union nuts 74 and 77. In this embodiment, the union nut 74 which is provided with cooling vanes 75 is pivotally fitted on a sealing cone 72 which is connected to the hose pipe 71 by means of a nipple 73. The union nut 77 which is provided with cooling vanes 78 is, however, rotatably held on a nipple 76 inserted in the hose pipe 71. It is therefore simple to provide a releasable connection between the steam hose 4 and the steam generator 2 by using the union nut 74, and between the steam hose 4 and the steam plate 3 by using the union nut 77.

If the heating element 16 is connected to a power source and if there is water in the interior 14 of the boiler 11, the water is evaporated by ebullition, and the hot steam is fed to the steam plate 3 by means of the steam hose 4, allowing the steam to act on wallpaper which is to loosened through the steam plate 3. The design of the boiler 11, the cover 21, the carrying handle 31 as well as the operating plate 51 and bow-shaped handle 61 means the possibility that an operator could be burned or scalded is to all intents and purposes excluded. In order to fill the interior 14 of the boiler 11, all that is required is to remove the steam hose 4 by loosening the union nut 74 from the filler neck 39 and to refill water into the boiler 11 through the filler neck 39.

Although the present invention has been described with reference to a specific embodiment, those of skill in the art will recognize that changes may be made thereto without departing from the scope and spirit of the invention as set forth in the appended claims.

We claim as our invention:

1. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation cavity provided between the carrying handle and the cover, the carrying handle, cavity and cover formed integrally as an injection molded part, the cover comprising a steam outlet at a front side of said handle and a relief valve at a rear side having a discharge opening arranged to discharge steam in a rearward direction.

2. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation barrier provided between the carrying handle attached to the cover of the steam generator and the cover;

wherein said barrier comprises at least one cavity provided between the carrying handle and the cover of the steam generator, said cavity being open at at least one side.

3. An apparatus according to claim 2, wherein the carrying handle is attached to the cover by means of at least two bars defining said cavity in a vertical direction and running at an approximately perpendicular angle to the longitudinal direction of the carrying handle.

4. An apparatus according to claim 2, wherein a stream collector housing is provided which is connected to the interior of the boiler and formed with the carrying handle at a second side of the carrying handle.

5. An apparatus according to claim 4, wherein the steam collector housing comprises a wall with a clearance from the second side of the carrying handle, in such a way that a cavity is formed between the carrying handle and the housing, open at least one side in order to provide thermal separation between the carrying handle and the housing.

6. An apparatus according to claim 5, wherein the wall of the housing facing away from the carrying handle is provided with a filler neck, which is shaped so as to provide a connection for the steam hose.

7. An apparatus according to claim 2, wherein the carrying handle is provided with a pressure relief valve which is replaceable and inserted in the end area of the carrying handle located diametrically opposite a steam collector housing above the boiler in order to automatically connect the interior of the boiler with the atmosphere upon the interior of the boiler reaching a predetermined pressure.

8. An apparatus according to claim 7, comprising an outlet opening open to the pressure relief valve, the outlet opening facing radially outwards at an approximately perpendicular angle to the longitudinal axis of the boiler.

9. An apparatus according to claim 2, wherein the cover is firmly connected to the boiler wall by means of heat sealing the cover onto the boiler wall.

10. An apparatus according to claim 9, comprising a ring formed onto the outside circumference of the boiler near the point where the boiler and the cover are joined.

11. An apparatus according to claim 2, wherein the external casing of the boiler is fitted in whole or in part with heat insulating ribs formed onto the casing and arranged at lateral intervals to each other.

12. An apparatus according to claim 2, wherein the heating element of the boiler is fitted in a depression formed in the base of the boiler.

13. An apparatus according to claim 2, wherein the steam plate comprises an operating plate and a bow-shaped handle connected thereto which is thermally separated by a barrier from the operating plate.

14. An apparatus according to claim 13, wherein the barrier comprises at least one cavity provided between the bow-shaped handle and the operating plate open at at least one side.

15. An apparatus according to claim 2, wherein the steam hose connecting the steam generator to the steam plate is removable at either end and connected to the steam generator and operating plate by means of union nuts, provided with circumferential or axial heat insulating ribs on their outer surfaces.

16. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation barrier provided between the carrying handle attached to the cover of the steam generator and the cover;

wherein said barrier comprises at least one cavity provided between the carrying handle and the cover of the steam generator, said cavity being open at at least one side;

wherein the carrying handle has substantially the shape of an obtuse-angled triangle, the first side of which is arranged so that it runs from the outer edge of the cover approximately in parallel to, and with a clearance from, the cover, with the second side of the triangle attached at a first end to a first end of the first side and projecting from this first end at an obtuse angle formed with the first side, and with the third side of the triangle, which is in the form of a grip, connected to respective second ends of the first and second sides of the carrying handle.

17. An apparatus in accordance with claim 16, wherein said carrying handle is integrally molded with said first side is supported by said cover at at least one position across said clearance and said handle provides cooling ribs on an inside surface of said third side facing said first side.

18. An apparatus in accordance with claim 16, wherein said steam generator comprises a steam outlet through said cover, and an insert arranged on an end of said third side opposite said steam outlet, said insert holding a relief valve therein in flow communication with said boiler, said relief valve having a nozzle means for relieving steam pressure in a direction away from said handle.

19. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation barrier provided between the carrying handle attached to the cover of the steam generator and the cover;

wherein the carrying handle is provided with a pressure relief valve which is replaceable and inserted in the end area of the carrying handle located diametrically opposite the steam collector housing in order to automatically connect the interior of the boiler with the atmosphere upon the interior of the boiler reaching a predetermined pressure;

an outlet opening facing towards the pressure relief valve which runs radially outwards at an approximately perpendicular angle to the longitudinal axis of the boiler; and wherein the outlet opening is provided between the cover of the boiler and the first side of the carrying handle, whereby the outlet opening is machined into an extension piece attached to the cover and is screened by the carrying handle.

20. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation barrier provided between the carrying handle attached to the cover of the steam generator and the cover;

wherein the steam plate comprises an operating plate and a bow-shaped handle connected thereto which is thermally separated by a barrier from the operating plate;

wherein the barrier comprises at least one cavity provided between the bow-shaped handle and the operating plate open at at least one side; and wherein the bow-shaped handle of the steam plate substantially has the shape of an obtuse-angled triangle, the first side of which is arranged so that it runs approximately in parallel to, and with a clearance from, the operating plate, with the second side of the triangle attached to the front end of the first side, with the third side of the triangle being in the form of a grip attached to the rear end of the first side, and with the second and third sides connected together at an obtuse angle.

21. An apparatus according to claim 20, wherein the first side of the bow-shaped handle extends along the axial length of the operating plate, and walls at front and rear sections of the steam plate are formed so they extend in the same direction as the second and third sides of the bow-shaped handle.

22. An apparatus according to claim 21, wherein the grip of the bow-shaped handle on the operating plate is provided with cooling vanes along at least a partial of an inwardly facing side thereof, facing said first side of said obtuse-angled triangle, in the form of machined notches.

23. An apparatus according to claim 21, wherein the grip of the carrying handle formed on the bow-shaped handle formed on the operating plate is convexly curved along its longitudinal length.

24. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle, and the steam generator containing a heating element to heat the water inside the boiler, comprising a thermal separation barrier provided between the carrying handle attached to the cover of the steam generator and the cover; and wherein the carrying handle formed on the cover has a cross section along at least a partial length of the carrying handle which is convexly curved on an inwardly facing side thereof toward the fillable boiler.

25. An apparatus for loosening wallpaper or similar coverings from a carrying agent by means of steam, in which the apparatus has a steam generator and a steam plate for outputting the steam which is connected to the steam generator by means of a flexible steam hose;

wherein the steam plate comprises an operating plate and a bow-shaped handle connected thereto which is thermally separated by a barrier from the operating plate;

wherein the barrier comprises at least one cavity provided between the bow-shaped handle and the operating plate open at at least one side.

26. An apparatus according to claim 25, wherein the bow-shaped handle provides a first side parallel to and overlying said operating plate, a second side extending from a first end of said first side and a third side extending from a second end of said first side and connected to said second side forming a triangle with said first and second sides, the first side of the bow-shaped handle extends along the axial length of the operating plate, and walls at front and rear sections of the steam plate are formed so they extend in the same direction as the second and third sides of the bow-shaped handle.

27. An apparatus according to claim 26, wherein the grip of the bow-shaped handle formed on the operating plate is provided with cooling vanes along at least a partial length of an inwardly facing side thereof, facing said first side of said handle, in the form of machined notches.

28. An apparatus for loosening wallpaper or similar coverings from a carrying agent by means of steam, in which the apparatus has a steam generator and a steam plate for outputting the steam which is connected to the steam generator by means of a flexible steam hose, the steam generator incorporating a fillable boiler which is closeable by means of a cover provided with a carrying handle and a steam outlet at a front side of the cover adjacent said handle, and the steam generator containing a heating element to heat the water inside the boiler, comprising a relief valve held within a recess of said cover, at a back side of said cover, said relief valve open to an inside of said boiler and having a discharge opening facing rearwardly of said handle.

29. The apparatus according to claim 28, wherein said discharge opening is recessed beneath an over hanging portion of said cover.

* * * * *